US007503148B2

(12) United States Patent
Lin

(10) Patent No.: US 7,503,148 B2
(45) Date of Patent: Mar. 17, 2009

(54) QUADRUPLE MONO TRUSS CONNECTION

(75) Inventor: Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 133 days.

(21) Appl. No.: 11/591,737

(22) Filed: Oct. 31, 2006

(65) Prior Publication Data

US 2008/0209845 A1 Sep. 4, 2008

(51) Int. Cl.
*E04B 7/08* (2006.01)

(52) U.S. Cl. ..... 52/643; 52/702; 52/714; 52/289; 248/300

(58) Field of Classification Search ..... 52/643, 52/289, 232.1, 92.2, 93.1, 702, 712, 715, 52/714; 248/300
See application file for complete search history.

(56) References Cited

U.S. PATENT DOCUMENTS

| | | | |
|---|---|---|---|
| 625,427 | A | 5/1899 | Stewart et al. |
| 828,488 | A | 8/1906 | Lanz |
| 974,606 | A | 11/1910 | Schrader |
| 1,343,647 | A | 6/1920 | Smith |
| 1,568,072 | A | 1/1926 | Krueger et al. |
| 1,719,440 | A | 7/1929 | Edwin |
| 1,785,791 | A | 12/1930 | Ropp |
| 1,787,167 | A | 12/1930 | Purdy |
| 1,925,804 | A | 9/1933 | Hiering |
| 1,945,925 | A | 2/1934 | Stiefel |
| 1,958,467 | A | 5/1934 | Buckle |
| 2,006,925 | A | 7/1935 | Klemp |
| 2,055,185 | A | 9/1936 | Templeton |
| 2,086,225 | A | 7/1937 | Hiering |
| 2,638,643 | A | 5/1953 | Olson |
| 2,988,854 | A | 6/1961 | McKinley |
| 2,990,590 | A | 7/1961 | Gravely |
| 3,036,347 | A | 5/1962 | Findleton |

(Continued)

FOREIGN PATENT DOCUMENTS

| | | |
|---|---|---|
| EP | 0 357 273 A1 | 3/1990 |

(Continued)

OTHER PUBLICATIONS

RTA/RTB/RTF/RTT/RTU/FW2 RIGID Tie Connectors, Simpsons Strong-Tie Connectors for Wood Construction Product & Instruction Manual Catalog C95H-1, p. 67, Simpson Strong-Tie Company, Inc. Pleasanton, CA, 1994.

(Continued)

*Primary Examiner*—Richard E Chilcot, Jr.
*Assistant Examiner*—Joshua Ihezie
(74) *Attorney, Agent, or Firm*—James R. Cypher; Charles R. Cypher

(57) ABSTRACT

An improved connector and connection formed with a seat member that is stiffened by first and second reinforcing flanges and first, second and third back wall members. When used as a hanger, the connector includes a seat member, first, second and third backwall members which are connected to a supporting girder and first and second side members are connected to the seat member. First, second, third and fourth flange arms integrally connected to the third back wall member are connected to up to four supported wood trusses or supported wood framing members which rest on the seat member.

18 Claims, 5 Drawing Sheets

U.S. PATENT DOCUMENTS

| | | | | | |
|---|---|---|---|---|---|
| 3,055,103 | A | | 9/1962 | Fernberg | |
| 3,271,861 | A | | 9/1966 | Fusco | |
| 3,338,084 | A | | 8/1967 | Stegman | |
| 3,423,898 | A | | 1/1969 | Tracey et al. | |
| 3,438,134 | A | | 4/1969 | Schunk | |
| 3,457,647 | A | | 7/1969 | Cohen et al. | |
| 3,596,941 | A | | 8/1971 | Tracy | |
| 3,601,428 | A | | 8/1971 | Gilb | |
| 3,633,950 | A | | 1/1972 | Gilb | |
| 3,730,466 | A | | 5/1973 | Swanquist | |
| 3,857,270 | A | | 12/1974 | Iten | |
| 3,879,144 | A | | 4/1975 | Eckerbrecht | |
| 3,972,169 | A | | 8/1976 | Sheppard, Jr. | |
| 4,230,416 | A | | 10/1980 | Gilb | |
| 4,291,996 | A | | 9/1981 | Gilb | |
| 4,410,294 | A | | 10/1983 | Gilb et al. | |
| 4,414,785 | A | | 11/1983 | Howell | |
| 4,423,977 | A | | 1/1984 | Gilb | |
| 4,449,335 | A | | 5/1984 | Fahey | |
| 4,480,941 | A | | 11/1984 | Gilb | |
| 4,498,801 | A | | 2/1985 | Gilb | |
| 4,525,972 | A | | 7/1985 | Palacio et al. | |
| 4,572,695 | A | | 2/1986 | Gilb | |
| 4,598,521 | A | | 7/1986 | Slapsys et al. | |
| 4,711,593 | A | | 12/1987 | Wilhelmi | |
| 4,717,279 | A | | 1/1988 | Commins | |
| 4,802,786 | A | | 2/1989 | Yauger | |
| 4,817,359 | A | * | 4/1989 | Colonias | 52/643 |
| 4,890,436 | A | * | 1/1990 | Colonias | 52/643 |
| 4,897,979 | A | * | 2/1990 | Colonias | 52/643 |
| 4,920,725 | A | | 5/1990 | Gore | |
| 4,932,173 | A | | 6/1990 | Commins | |
| 4,964,253 | A | * | 10/1990 | Loeffler | 52/289 |
| 5,022,209 | A | | 6/1991 | Kimura | |
| 5,042,217 | A | | 8/1991 | Bugbee et al. | |
| 5,104,252 | A | | 4/1992 | Colonias et al. | |
| 5,203,069 | A | | 4/1993 | Hennig | |
| 5,236,273 | A | | 8/1993 | Gilb | |
| 5,253,465 | A | * | 10/1993 | Gilb | 52/643 |
| 5,263,296 | A | | 11/1993 | Spera | |
| 5,274,981 | A | * | 1/1994 | Commins | 52/712 |
| 5,341,619 | A | | 8/1994 | Dunagan et al. | |
| 5,364,312 | A | | 11/1994 | Cunard et al. | |
| 5,380,115 | A | | 1/1995 | Colonias | |
| D355,349 | S | | 2/1995 | Taparauskas, Jr. | |
| 5,457,928 | A | * | 10/1995 | Sahnazarian | 52/702 |
| D363,862 | S | | 11/1995 | Lusignan | |
| D364,331 | S | | 11/1995 | Leek | |
| 5,524,397 | A | | 6/1996 | Byers et al. | |
| 5,598,680 | A | | 2/1997 | Wilhelmi | |
| 5,603,580 | A | | 2/1997 | Leek et al. | |
| 5,653,079 | A | * | 8/1997 | Loeffler et al. | 52/712 |
| 5,666,774 | A | | 9/1997 | Commins | |
| 5,678,379 | A | * | 10/1997 | Quattrociocchi | 52/712 |
| D392,144 | S | | 3/1998 | Vogler | |
| 5,727,831 | A | | 3/1998 | Dritlein, Jr. | |
| 5,806,265 | A | | 9/1998 | Sluiter | |
| 5,951,078 | A | | 9/1999 | Whitehead et al. | |
| 5,987,828 | A | | 11/1999 | Hardy | |
| 6,230,466 | B1 | | 5/2001 | Pryor | |
| 6,230,467 | B1 | * | 5/2001 | Leek | 52/702 |
| 6,254,306 | B1 | | 7/2001 | Williams | |
| 6,260,402 | B1 | | 7/2001 | Leek | |
| 6,338,511 | B1 | | 1/2002 | Douglas et al. | |
| 6,446,409 | B1 | | 9/2002 | Emerson | |
| 6,560,943 | B1 | * | 5/2003 | Leek et al. | 52/715 |
| 6,625,945 | B2 | | 9/2003 | Commins | |
| 6,655,099 | B1 | | 12/2003 | Trenoweth | |
| 6,662,517 | B1 | | 12/2003 | Thompson | |
| 6,983,548 | B1 | | 1/2006 | Cook et al. | |
| 7,007,432 | B2 | | 3/2006 | Commins | |
| 2002/0002806 | A1 | | 1/2002 | Commins et al. | |
| 2004/0079044 | A1 | | 4/2004 | Troth et al. | |

FOREIGN PATENT DOCUMENTS

| | | |
|---|---|---|
| EP | 1 413686 A1 | 4/2004 |
| GB | 185694 | 9/1922 |
| GB | 422765 | 1/1935 |
| GB | 1179267 | 1/1970 |
| GB | 2 018 935 | 10/1979 |
| GB | 2 070 184 A | 9/1981 |
| GB | 2 228 955 | 9/1990 |
| JP | 6-262267 | 9/1994 |
| WO | WO 00/53352 | 9/2000 |

OTHER PUBLICATIONS

"Glulam Saddle Hanger" Strong-Tie Connectors, Catalog No. 71H1, Simpson Strong-Tie Company, Inc. 1971, p. 13.

"EPB44T Elevated Post Bases" Simpson Strong-Tie Connectors - Wood Constructions Connectors, Catalog C02000, Simpson Strong-Tie Company, Inc. 2000, p. 34.

"HJ Hip & Jack TRuss Hanger" Product Data Sheet. Cleveland Steel Specialty Co. 1986.

"Structural Truss Connectors." Lumberlok: Structural Framing Connectors Catalo & Specifications. p. 37, Lumberlok. Hayward, Calif. 1988.

"THJA26 Truss Hip and Jack Hanger." Product Data Sheet. Simpson Strong-Tie Company, Inc. San Leandro, Calif. 1991.

"MTHM/MTHM-2 Multiple Truss Hangers." Simpson Strong-Tie Company Wood Construction Connectors Catalog C-2000, p. 92. Simpson Strong-Tie Company, Inc. Pleasanton, Calif. 1999.

"RTC Rigid Tie™ Connectors." Simpson Strong-Tie Company Wood Construction Connectors Catalog C-2000, p. 113. Simpson Strong-Tie Company, Inc., Pleasanton, Calif. 1999.

"SBV/CF Shelf Bracket - Concrete Form Angle" Simpson Strong-Tie Connectors for Wood Construction Product & Instruction Manual Catalog C95H-1, p. 65. Simpson Strong-Tie Company, Inc. Pleasanton, Calif. 1994.

"Panelized Construction" *Handbook of Structural Designs & Load Values*. Simpson Strong-Tie Timber Connectors, Catalog No. 79H-1 1979. Simpson Strong-Tie Co., Inc. Copyright 1978, p. 16.

"Formed Seat Joist Hangers." *Joist Hangers and Framing Connectors. Structural Designs & Load. Values*. Simpson Catalog No. 66H1. Simpson Strong-Tie Co., Inc.Copyright 1965, p. 3.

*Konstruieren mit Sichtholz-Verbindern und der größten Auswahl einbaufertiger Serienteile*. Bulldog-Simpson Bausysteme Für Holz catalog, Bulldog-Simpson GmbH catalog,Copyright 1999, Cover Page and p. 3.

* cited by examiner

QUADRUPLE MONO TRUSS CONNECTION

BACKGROUND

This invention relates to a connector for joining structural members. In particular, the connector of the present invention has particular application as a sheet metal hanger for joining multiple truss and framing members.

In the particular application for joining multiple members, the framing members may be either standard dimension lumber or wood trusses and truss girders. Specifically, the connection is most typically made at the juncture of the supporting truss girder or framing header and one or two hip framing members or wood trusses or a hip truss or wood framing member and a jack framing member or jack truss; or two hip and two jack trusses or four wood framing members.

Prior art U.S. Pat. No. 5,253,465, granted to Tyrell T. Gilb teaches a sheet metal connector for connecting multiple truss connections and is herein incorporated by reference and made a part of this application. (See drawing FIG. 5 of this application entitled Prior Art.) U.S. Pat. No. 4,817,359, granted to Karen Colonias also teaches a similar connection with a sheet metal hanger; however, neither of the patents teach the improved connector or connection of the present invention for holding up to four trusses or framing members.

SUMMARY OF THE INVENTION

The improved connector and connection of the present invention provides a connector with a seat member that is stronger and less likely to deflect under load conditions. The seat member is less likely to deflect because it is stiffened by first and second reinforcing flange members that extend across the entire seat member, by a major embossment in the seat and by a third back wall member.

The present invention for holding four trusses or four framing members is lighter than commercially available hangers for holding four trusses of four framing members; yet, the present invention holds greater loads.

The present invention, unlike the presently commercially available hanger, requires no welding or painting and is easier and less expensive to manufacture.

The present invention is easier to install than the presently available commercial hanger because the truss or framing member arms are initially more flexible and can, unlike the commercially available hanger, be field bent to accommodate some initial misalignment of the trusses or framing members being supported.

The improved connector of the present invention, when used as a multiple framing member or truss connector is capable of making several separate connections: viz.; (A). joining to a support girder, (1) a right hip truss and a jack truss, (2) a left hip truss and a jack truss, (3) a right and left hip truss (4) two jack trusses, (5) a left hip truss and two jack trusses, or (6) right and left hip trusses and two jack trusses; or (B) joining to a support header, (1) a right hip framing member and a jack framing member, (2) a left hip framing member and a jack framing member, (3) a right and left hip framing member, (4) two jack framing members, (5) a left hip framing member and two jack framing members, or (6) right and left hip framing members and two jack framing members.

Another advantage of the present invention when used as a multiple truss hanger connector or a multiple framing member hanger connector is that the seat of the present connector better resists deflection.

DESCRIPTION OF THE PREFERRED EMBODIMENTS OF THE INVENTION

Figure 2:
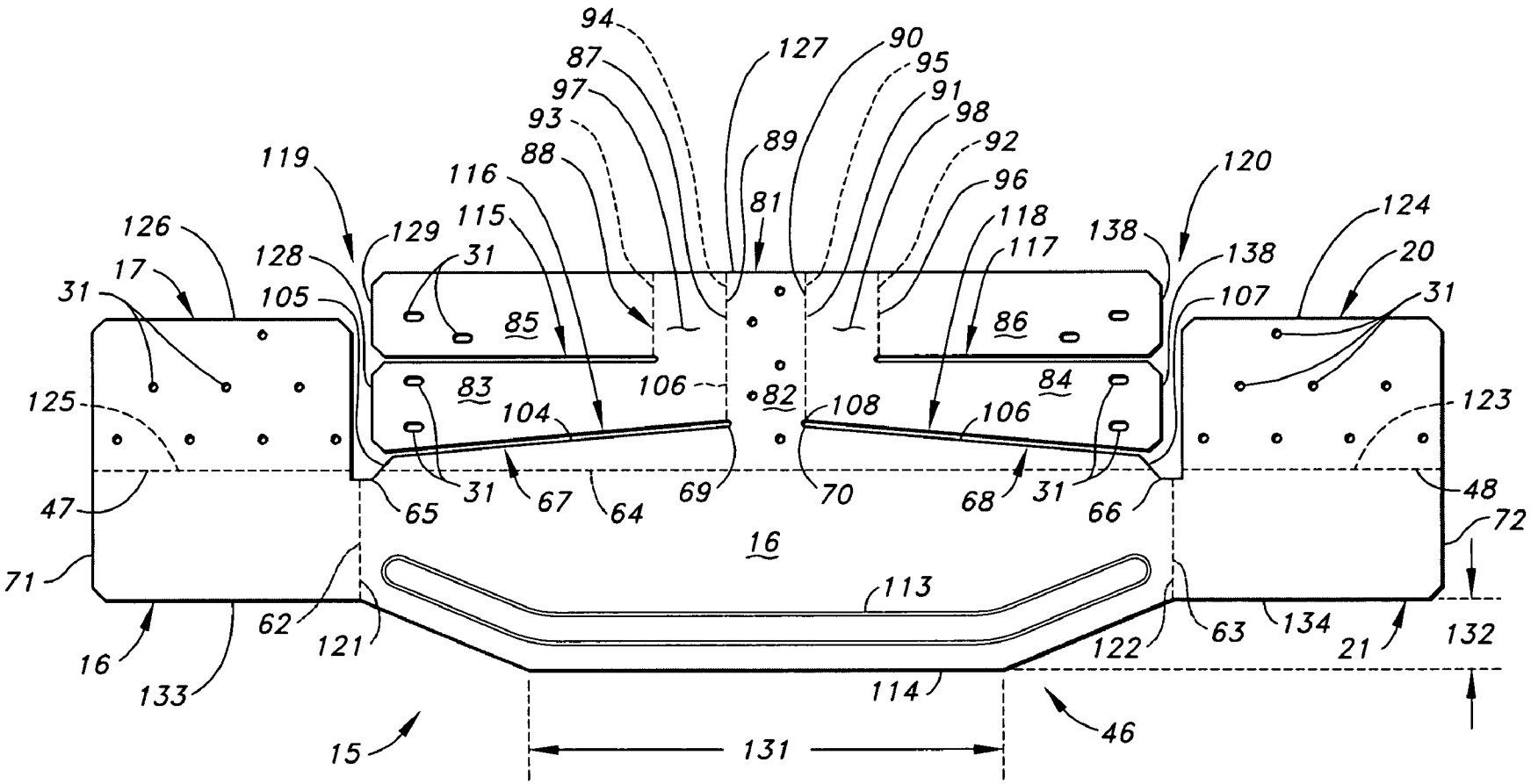
FIG. 2 is a top plan view of a sheet metal blank prior to bending from which a sheet metal hanger is formed according to the present invention illustrated in FIG. 1.
Figure 3:
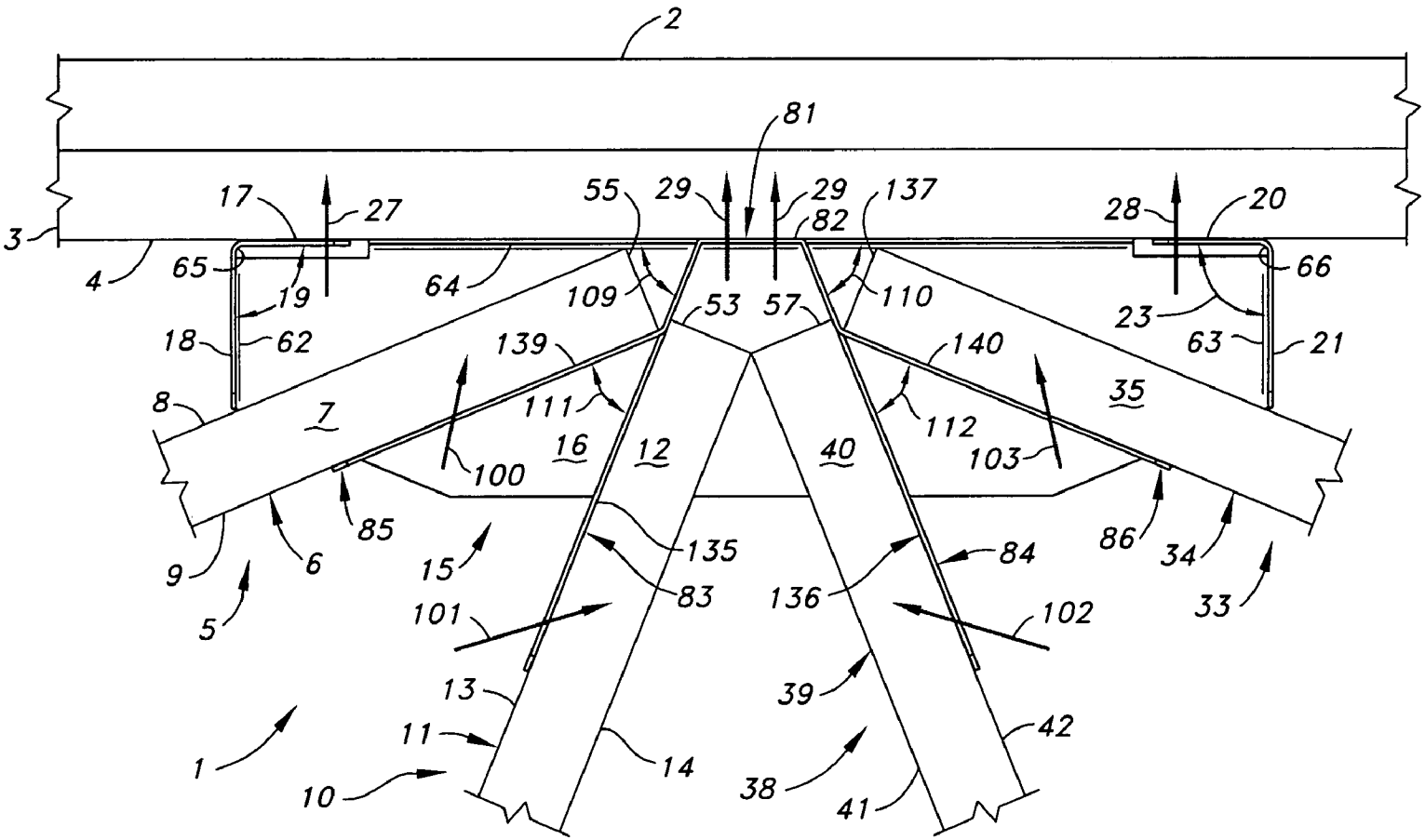
FIG. 3 is a top plan view of the multiple framing member connection illustrated in FIG. 1 and illustrating two hip trusses and two jack trusses connected by a hanger formed according to the present invention.

Referring to FIGS. 2 and 3 of the drawings, the present invention consists briefly of a building structural hanger 15 including: a seat member 16 having a first seat edge 62, a second seat edge 63, and a third seat edge 64, wherein first seat edge 62 intersects third seat edge 64 at a first virtual corner 65, and second seat edge 63 intersects third seat edge 64 at a second virtual corner 66, and second virtual corner is spaced from first virtual corner 65 along third seat edge 64; a first reinforcing flange 67 extending along third edge 64 of seat member 16 from adjacent first virtual corner 65, and first reinforcing flange 67 extends upwardly from seat member 16 to a maximum selected height 69; a first side member 18 having a first edge 62 connected to a portion of first seat edge 62 adjacent first virtual corner 65 and first side member 18 extends upwardly from seat member 16 to a maximum selected height 71 greater than the maximum selected height 69 of first reinforcing flange member 67; and first side member 18 has a first bend line 47 in the same plane as first reinforcing flange member 67; a first back wall member 17 having a first edge 125 extending along a portion of bend line 47 of first side member 18, with first back wall member 17 having a second edge 126 spaced from first edge 125 of first back wall member 17; and a second side member 21 having a first edge 122 connected to a portion of second seat edge 63 adjacent second virtual corner 66, and second side member 21 extending upwardly from seat member 16 to a maximum selected height 72 greater than second reinforcing flange 68; and second side member 21 having a first bend line 48 in the same plane as second reinforcing flange 68; and a second back wall member 20 having a first edge 123 extending along a portion of bend line 48 of second side member 21, and second back wall member 20 having a second edge 124 spaced from first edge 123 of second back wall member 20; and a third backwall member 81 extending upwardly from third edge 64 of seat member 16 a selected height 127 greater than the maximum selected heights 69 and 70 of both first and second reinforcing flanges 67 and 68 and having, a first side edge 89 spaced a substantial distance from first virtual corner 65, and a second side edge 90 spaced a substantial distance from second virtual corner 66; and a first L-shaped flange arm 83 having a distal end 128 and an end edge 87 connected to third back wall member 81 along first side edge 89 of third backwall member 81 and bent at an angle 109 from third back wall member 81.

In a second form of the present invention, building structural hanger 15 includes the elements described in the above paragraph, and in addition includes: a third flange arm 85 having an end edge 88 integrally attached to end portion 97 of first L-shaped flange arm 83 along a substantial portion of bend line 93 and third flange arm 85 extends a selected distance to distal end 129, and third flange arm 85 is bent along bend line 93 forming an acute angle 111 with end portion 97 of first L-shaped flange arm 83.

As set forth above, due to the unique construction of the building structural hanger 15, the same hanger 15 can hold 1 or 2 hangers. While this is somewhat inefficient, yet this factor can be an important time factor to a contractor on the job who finds that custom hangers for holding one, two or even three trusses were not delivered to the job site. To accommodate less than 4 trusses, only minor on site bending need be done to fashion an acceptable hanger. The structure for a hanger capable of holding three trusses is as follows and includes: a second reinforcing flange 68 extending along third edge 64 of seat member 16 from adjacent second virtual corner 66, the second reinforcing flange 68 extends upwardly from seat member 16 to a maximum selected height 70; and second flange arm 84 having a distal end edge 130 and a proximal end portion 98 having a proximal end bend edge 91 is connected to third back wall member 81 along second side edge 90 of third backwall member 81 and bent at an angle 110 from third back wall member 81.

The preferred form of the invention is capable of attaching four mono trusses to a supporting girder as shown in FIG. 3. The unique structure for accomplishing this building structure is a building structural hanger 15 as previously described and in addition including the following: a second flange arm 84 is L-shaped and the proximal end portion 98 is formed with a distal bend edge 96 spaced from and parallel to the proximal end bend edge 91; a fourth flange arm 85 having a distal end 129 and a proximal end edge 88 integrally attached to the distal bend edge 93 of the first L-shaped flange arm 83, and a third flange arm 86 being bent along the proximal bend edge 92 forming an acute angle 112 with the proximal end portion 98 of the second L-shaped flange arm 84.

As previously stated, the building structural hanger 15 of the present invention is strong yet light due to the structure set forth above. Structural design factors contributing to these advantageous attributes for constructing a building structural hanger 15 include the following: seat member 16 is formed with a substantial portion 131 of front edge 114 extending a selected distance 132 beyond forward side edges 133 and 134 of first and second side members 18 and 21, an embossment 113 in seat member 16 extending a substantial portion of the length of seat member 16 adjacent and in a non linear line in general conformity with the front edge 114 of seat member 16; and building structural hanger 15 is constructed from a single contiguous sheet of sheet metal.

Preferably building structural hanger 15 as previously described is constructed so that first and second reinforcing flange members 67 and 68 are integrally attached to the third back wall member 81.

Preferably building structural hanger 15 as previously described is constructed so that fastener opening means 31 in first and second L-shaped flange arms 83 and 84 and fastener opening means 31 in third and fourth flange arms 85 and 86 are obround in shape permitting slant insertion of fasteners therethrough.

As shown in FIG. 3, building structural hanger 15 as previously described, may be initially constructed or modified in the field so that the first and second back wall members 17 and 20 are bent inwardly toward third back wall member and on a plane with the third back wall member 81.

Figure 4:
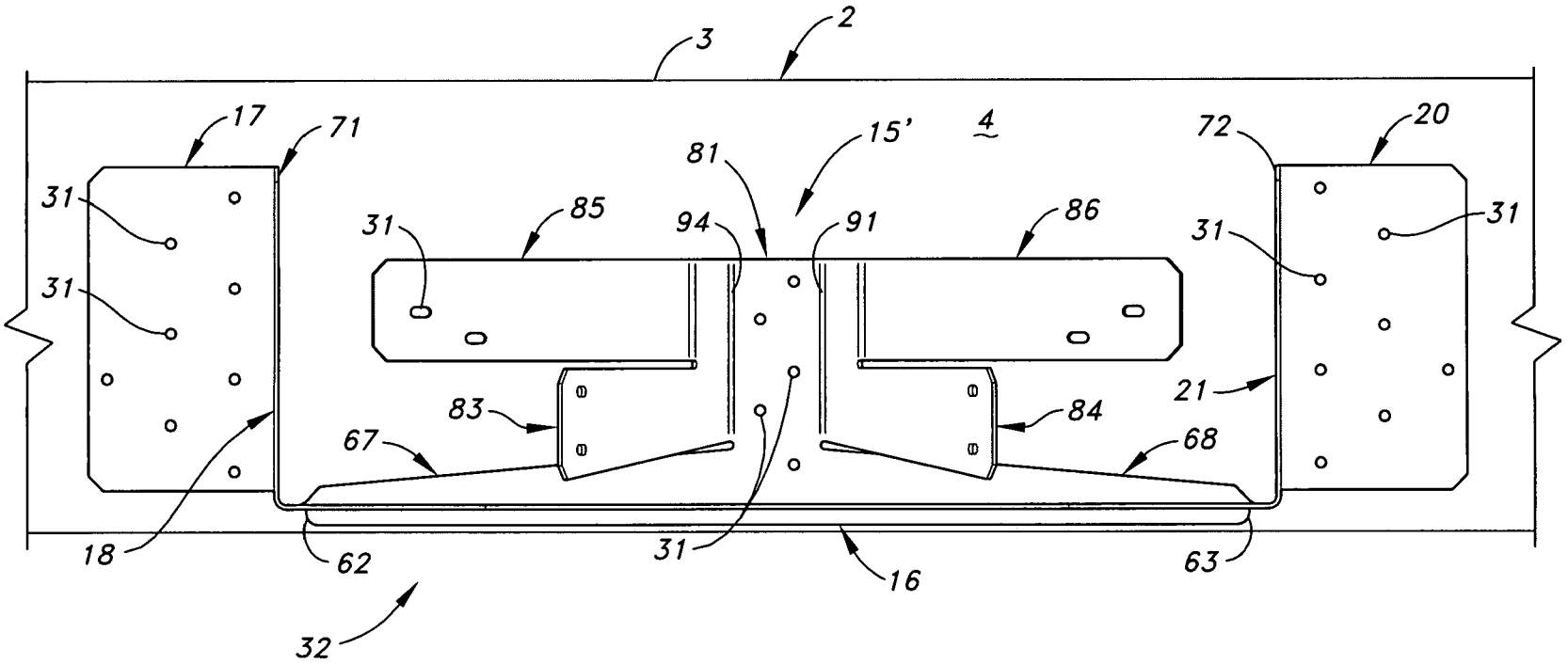
FIG. 4 is a perspective view of another multiple framing member connector hanger formed according to the present invention.
Figure 5:
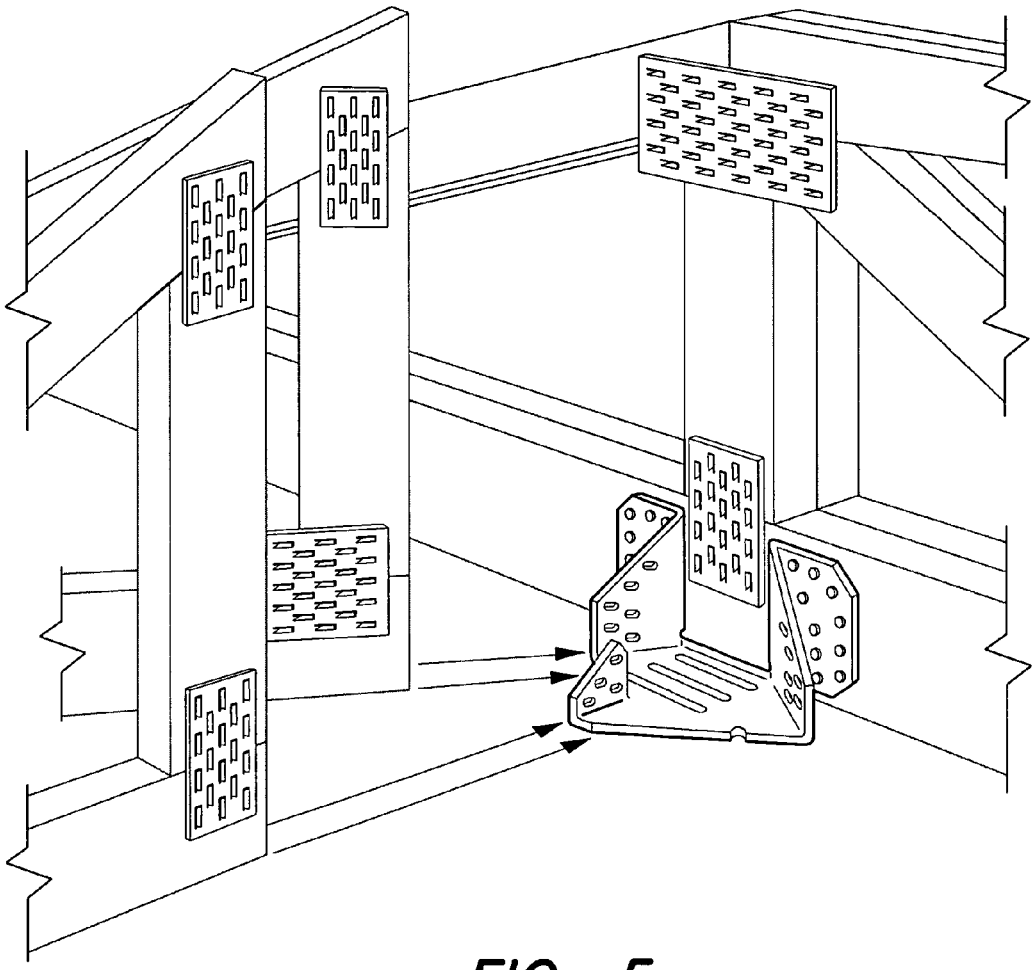
FIG. 5 (PRIOR ART)
FIG. 5 is a perspective view of a prior art hanger patented by Gilb U.S. Pat. No. 5,253,465.

As shown in FIG. 4, building structural hanger 15 as previously described may be initially constructed or modified in the field so that the first and second back wall members 17 and 20 are bent outwardly, away from third back wall member and on a plane with the third back wall member 81.

Referring to FIG. 3, it may be seen how one, two, three or even four trusses may be mounted on the building structural hanger 15 previously described. The truss connection 1 for one supported truss is described as follows: The truss connection 1 includes: a support girder 2 including a wood bottom chord 3 having a front face 4, first fasteners 27, third fasteners 29 and second fasteners 28 inserted respectively through first backwall member 17, third backwall member 81 and second back wall member 20 into bottom wall chord 3 of the support girder 2, a first jack truss 10 including a wood bottom chord 11 having a bottom edge 12, an end face 53 and parallel first and second sides 13 and 14, bottom edge 12 of first jack truss 10 is mounted on seat 16 of building structural hanger 15 with end face 53 of first jack truss 10 mounted adjacent and spaced from third edge 64 of seat member 16 and with first side 13 of wood bottom chord 11 mounted flush with face 135 of first flange arm 83, and second arm fasteners 101 inserted through first flange 83 arm into wood bottom chord 11.

The truss connection 1 for two supported trusses is described as follows: The truss connection 1 includes: first flange arm 83 is L-shaped and proximal end portion 97 is formed with a distal bend edge 93 spaced from and parallel to proximal end bend edge 87; third flange arm 85 having a distal end edge 129 and a proximal bend edge 88 integrally attached to distal bend edge 93 of first L-shaped flange arm 83, third flange arm 85 being bent along proximal end edge 88 forming an acute angle 111 with proximal end portion 97 of first L-shaped flange arm 83, first hip truss 5 including a wood bottom chord 6 having a bottom edge 7, an end face 55 and parallel first and second sides 8 and 9, bottom edge 7 of first hip truss 5 is mounted on seat 16 of building structural hanger 15 with end face 55 of first hip truss 5 mounted adjacent third edge 64 of seat member 16 and with second side 9 of wood bottom chord 6 mounted flush with face 139 of flange arm 85, and first arm fasteners 100 inserted through third flange arm 85 into wood bottom chord 6.

An alternate configuration for holding two trusses with the trusses spaced on either side of the mid line of the connector 15 is briefly described and includes the following elements: a second reinforcing flange 68 extending along third edge 64 of seat member 16 from adjacent second virtual corner 66, second reinforcing flange 68 extending upwardly from seat member 16 to a maximum selected height 70; a second flange arm 84 having a distal end edge 130 and a proximal end portion 98 having a proximal end bend edge 91 connected to third back wall member 81 along second side edge 90 of third backwall member 81 and bent at an angle 110 from third back wall member 81; a second jack truss 38 including a wood bottom chord 39 having a bottom edge 40, an end face 57 and parallel first and second sides 41 and 42; bottom edge 40 of second jack truss 38 is mounted on seat 16 of building structural hanger 15 with end face 57 of second jack truss 38 mounted adjacent and spaced from third edge 64 of seat member 16 and with second side 42 of wood bottom chord 39 mounted flush with face 136 of second flange arm 84, and third arm fasteners 102 inserted through second flange arm 84 into wood bottom chord 39.

Another alternate connection is described below in which the connection includes two jack trusses and a single hip truss and further includes: a first flange arm 83 which is L-shaped and has a proximal end portion 97 formed with a distal bend edge 93 spaced from and parallel to the proximal end bend edge 87, a third flange arm 85 bent along the proximal end edge 88 forming an acute angle 111 with the proximal end portion 97 of first L-shaped arm 83, a first hip truss 5 including a wood bottom chord 6 having a bottom edge 7, an end face 55 and parallel first and second sides 8 and 9, a bottom edge 7 of first hip truss 5 is mounted on seat 16 of building structural hanger 15 with end face 55 of first hip truss 5 mounted adjacent third edge 64 of seat member 16 and with second side 9 of wood bottom chord 6 mounted flush with face 139 of third flange arm 85, and first arm fasteners 100 inserted through third flange arm 85 into wood bottom chord 6.

Still another alternate connection is described below in which the connection includes two hip trusses and a single jack truss and further includes: a second L-shaped flange arm 84 having a distal end edge 130 and a proximal end portion 98 is formed with a distal bend edge 96 spaced from and parallel to proximal end bend edge 91 connected to third backwall member 81; a fourth flange arm 86 having a distal end edge 138 and a proximal bend edge 92 integrally attached to distal bend edge 96 of second L-shaped flange arm 84, a fourth flange arm 86 being bent along proximal end edge 96 forming an acute angle 112 with proximal end portion 98 of second L-shaped flange arm 84, a second hip truss 33 having a wood bottom chord 34 having a bottom edge 35 placed on seat member 16 and an end face 137 positioned adjacent third edge 64 of seat member 16 and in registration with face 140 of fourth flange arm 86 and; fourth arm fasteners 103 inserted through fourth flange arm 86 and into wood bottom chord 34 of second hip jack truss 33.

A still further alternate connection is described below in which the connection includes two hip trusses and two jack trusses and further includes: a second arm 84 having an L-shape having a distal end edge 130 and a proximal end portion 98 formed with a distal bend edge 96 spaced from and parallel to proximal end bend edge 91 connected to third backwall member 81; a fourth flange arm 86 having a distal end edge 138 and a proximal bend edge 92 integrally attached to distal bend edge 96 of second L-shaped flange arm 84, a fourth flange arm 86 bent along proximal end edge 96 forming an acute angle 112 with proximal end portion 98 of second L-shaped flange arm 84; a second hip truss 33 having a wood bottom chord 34 having a bottom edge 35 placed on seat member 16 and an end face 137 positioned adjacent third edge 64 of seat member 16 and in registration with face 140 of fourth flange arm 86 and; fourth arm fasteners 103 inserted through fourth flange arm 86 and into wood bottom chord 34 of second hip jack truss 33.

Preferably the connections 1 include building structural hangers 15 which have the fastener opening means 31 in the first and second L-shaped flange arms 83 and 84 and fastener openings 31 in the third and fourth flange arms 85 and 86 which are obround in shape permitting slant insertion of fasteners therethrough.

Another alternate form of the truss connection of the present invention is best shown in FIG. 3. As shown, first back wall member 17 is bent inwardly along second edge 126 of first back wall member 17 toward third back wall member 81 and on a plane with third back wall member 81; and second back wall member 20 is bent inwardly along first edge 123 of second back wall member 20 toward third back wall member 81 and on a plane with third back wall member 81.

A further alternate truss connection of the present invention is shown in FIG. 4 and includes: a first back wall member 17 bent outwardly along second edge 126 of first back wall member 17 away from third back wall member 81 and on a plane with third back wall member 81; and a second back wall member 20 bent outwardly along first edge 123 of second back wall member 20 away from third back wall member 81 and on a plane with third back wall member 81.

FIG. 3 shows a multiple truss connection 1 including: a support girder 2 having a wood bottom chord 3 with a front face 4; a first hip truss 5 having a wood bottom chord 6 with a bottom edge 7 and parallel first and second sides 8 and 9; a first jack truss 10 having a wood bottom chord 11 having a bottom edge 12 and parallel first and second sides 13 and 14; and a sheet metal hanger 15 formed according to the present invention.

Figure 1:
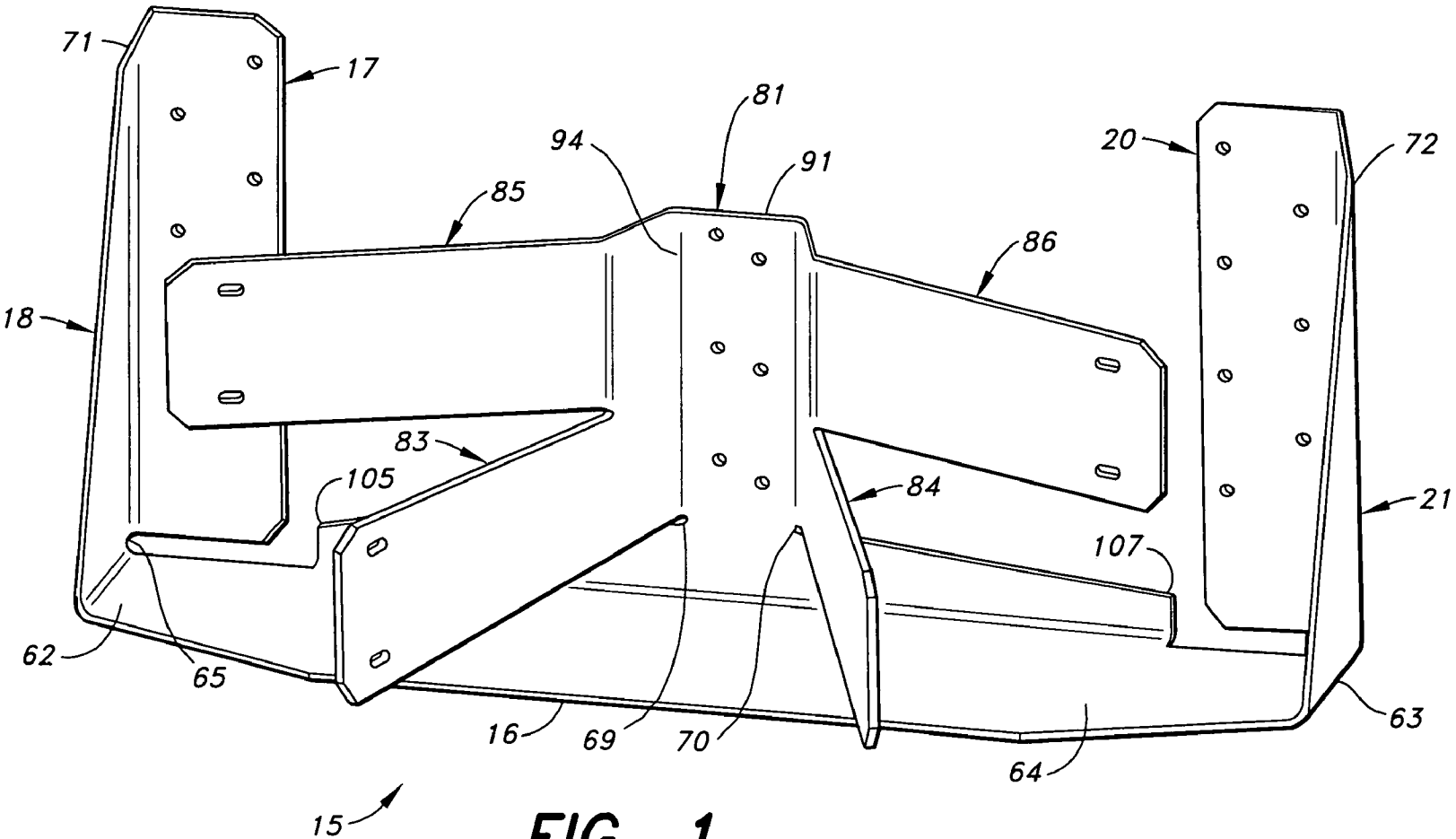
FIG. 1 is a perspective view of the present connector invention used as a multiple truss hanger or multiple framing member hanger.

As shown in FIGS. 1, 2 and 3, sheet metal connector 15 is formed according to the present invention and has a seat member 16. The seat member is formed with at least a first preferably folded edge 62, a second preferably folded edge 63, and a third preferably edge 64. The first edge 62 of the seat member 16 intersects with the third edge 64 at a first corner 65, and the second edge 63 intersects with the third edge 64 at a second corner 66. The first and second corners 65 and 66 are distinct from each other. The first and second corners 65 and 66 are spaced away from each other a selected distance along the third edge 64. As described here, the seat member 16 is defined by at least three edges 62, 63 and 64. Although the edges 62, 63 and 64 shown in FIGS. 2 and 3 are shown as being substantially linear, the edges 62, 63 and 64, according to the present invention need not be straight, but could be arcs or curves, although, according to the present invention, the edges 62, 63 64 should not be segments of one arc on a circle described by a single radius.

In a connector 15 formed according to the present invention, first and second reinforcing flanges 67 and 68 are connected to the seat 16. The first reinforcing flange 67 is connected to a portion of the third edge 64 of the seat member 16 near the first corner 65, and the first reinforcing flange 67 may extend around the first corner 65 to connect to a portion of the first edge 62. The second reinforcing flange 68 is connected to a portion of the third edge 64 of the seat member 16 near the second corner 66, and the second reinforcing flange 68 may extend around the second corner 66 to connect to a portion of the second edge 63.

The first and second reinforcing flanges 67 and 68 extend upwardly from the seat member 16 to maximum selected heights 69 and 70, respectively.

As shown in FIGS. 1, 2, 3 and 4 the first and second reinforcing flanges 67 and 68 preferably extend along the third edge 64 towards each other and are joined to each other at a point along third edge 64.

In a connector 15 formed according to the present invention, a first side member 18 is connected to a portion of the first edge 62 of the seat member 16. This first side member 18 extends upwardly from the seat member 16 to a maximum selected height 71 that is substantially greater than the maximum selected height 69 of the first reinforcing flange 67. The first side member 18 and the first reinforcing flange 67 are distinct members.

In a connector 15 formed according to the present invention, a second side member 21 is connected to a portion of the second edge 63 of the seat member 16. This second side member 21 extends upwardly from the seat member 16 to a maximum selected height 72 that is substantially greater than the maximum selected height 70 of the second reinforcing flange 68. The second side member 21 and the second reinforcing flange 68 are distinct members.

As best shown in FIGS. 1 and 2, the first and second side members 18 and 21 are connected to each other only through seat member 16.

The preferred hanger 15 formed according to the present invention for making a multiple framing member connection also includes: a seat member 16, as previously mentioned, for receiving the bottom edges 7 and 12 of the first hip truss 5 and the first jack truss 10 respectively; a first backwall member 17 formed to register with this front face 4 of the support girder 2; a first side member 18 integrally connected to the first backwall member 17 at a right angle 19 and integrally connected to the seat member 16; a second backwall member 20 spaced from the first backwall member 17 formed for registration with the front face 4 of the support girder 2; a second side member 21 integrally connected to the second backwall member 20 at a right angle 22, and integrally connected to the seat member 16; and a third backwall member 81 having a first face 82 integrally connected to the seat member 16 through reinforcing flanges 7 and 68 and extending upwardly therefrom and located adjacent the end face 53 of first jack truss 10 and in registration with the front face 4 of the support girder 2.

Still referring to FIG. 2, third backwall member 81 is integrally formed with the other parts of sheet metal hanger 15 as previously stated and further includes the following integrally formed parts: (1). first L-shaped flange arm 83 is integrally attached at its end edge 87 to first edge 89 of third backwall member 81 along second bend line 94 formed in end portion 97 of L-shaped flange arm 83 which is parallel to and spaced from first bend line 93; (2). third flange arm 85 is integrally attached at its end edge 88 along first bend line 93 formed in the end portion 97 of L-shaped flange arm 83; (3). second L-shaped flange arm 84 is integrally attached at its end edge 91 to second side edge 90 of third backwall member 81 along third bend line 95 formed in end portion 98 of L-shaped flange arm 84 which is parallel to and spaced from second bend line 94; and (4). fourth flange arm 86 is integrally attached at its end edge 92 along fourth bend line 96 formed in the end portion 98 of second L-shaped flange arm 84 and parallel to third bend line 95.

Referring to 3, first fasteners 27 insert through the first backwall member 17 into the support girder 2, second fasteners 28 insert through the second backwall member 20 into the support girder 2, third fasteners 29 insert through the third back wall member 81 into the support girder 2, first arm fasteners 100 insert through the third flange arm 85 into the bottom chord 6 of first hip truss 5; second arm fasteners 101 insert through first L-shaped arm 83 into bottom chord 11 of the first jack truss 10, third arm fasteners 102 insert through second L-shaped flange arm 84 into bottom chord 39 of second jack truss 38 and fourth arm fasteners 103 insert through flange arm 86 and into bottom chord 34 of second hip truss 33 to complete the multiple truss connection 1.

Referring to FIG. 2, preferably, first reinforcing flange 67 is formed with an edge 104 which rises in height generally uniformly from a point 105 near first corner 65 to a point 69 which is the maximum selected height of first reinforcing flange 67. Preferably, point 69 is at or adjacent the lower end 106 of second bend line 94.

Still referring to FIG. 2, preferably second reinforcing flange 68 is formed with an edge 106 which rises in height generally uniformly, from a point 107 near second corner 66 to a point 70 which is the maximum selected height of second reinforcing flange 68. Preferably, point 70 is at or adjacent the lower end 108 of third bend line 95.

For ease in making the installation, fastener opening means 31 are formed in the first backwall member 17, the second backwall member 20, the first L-shaped flange arm 83, the second L-shaped flange arm 84, the third flange arm 85 and the fourth flange arm 86 for permitting slant angle fastening.

Another multiple truss connection 32 is illustrated in FIG. 4, using the preferred hanger 15, formed according to the present invention, for making a multiple framing member connection. This connection also includes a support girder 2 having a wood bottom chord 3 having a front face 4.

The only difference between sheet metal hanger 15 illustrated in FIGS. 1 and 3 with the sheet metal hanger 15' illustrated in FIG. 4 is the fact that in FIGS. 1 and 3, the first and second back wall members 17 and 20 are rotated inwardly 90° with respect to first and second side members 18 and 21, whereas in FIG. 4, first and second backwall members 17 and 20 are rotated outwardly 900 with respect to first and second side members 18 and 21.

Preferred hanger 15 in FIGS. 1 and 3 and hanger 15' in FIG. 4, are made from the same hanger blank shown in FIG. 2. Since the only change is in bending first and second back wall members 17 and 20, as set forth above, the numbering of the elements of hanger 15' in FIG. 4 is the same as the numbering of the elements of hanger 15 in FIGS. 1, 2 and 3. For purposes of brevity, the description of the elements in FIG. 4 is not repeated in the specification.

Referring to FIG. 3, the arrangement of the flange arms 83, 84, 85, and 86 and the placement and attachment of the four trusses 5, 10, 38, and 33 is as follows.

The bottom edges 7, 12, 40, and 35, of bottom chords 6, 11, 39, and 34 respectively rest on seat 16 of sheet metal hanger 15. First and second L-shaped flange arms 83 and 84 are connected to third backwall member 81 at angles of approximately 70° as indicated by angles 109 and 110. Third and fourth flange arms 85 and 86 are connected to L-shaped flange arms 83 and 84 at angles of approximately 45° as indicated by angles 111 and 112. Angled pluralities of fasteners 100, 101, 102 and 103 connect bottom chords 6, 11, 39, and 34 to flange arms 83, 84 85, and 86 as illustrated in FIG. 3 and described above.

The placement of the four trusses 5, 10, 38 and 33, on seat member 16 of sheet metal hanger 15' and connection of the chords 6,11, 39, and 34 to flange arms 83, 84, 85, and 86 is the same as described above with respect to the sheet metal hanger 15 illustrated in FIGS. 1, 2 and 3 and for purposes of brevity is not repeated.

Although the four trusses are closely space, the use of obround openings in fastener openings 31 permits slant nailing so that hammers or nailing guns can easily drive nail fasteners through the openings in the sheet metal hangers 15 and 15' and into the truss chords 6, 11, 39, and 34 without difficulty.

The hanger of the present invention is not limited to making multiple truss connections, but may also be used in a multiple framing member connection. The description of the following multiple framing member connection is identical to the multiple truss connection described earlier except that simple framing members are described. The framing members could be made out of any common building material for structural framing members such as wood or steel. If wood framing members are used they could be standard wood framing members such as 2×6's, 2×8's or other standard size lumber that may be used instead of wood trusses. No change has been made in the numbering system and no separate drawings of standard lumber have been made as the drawings in plan view would look identical. The following description is provided for preferred wood framing members.

A multiple framing member connection 1 made with a hanger formed according to the present invention includes: a support header member 2 having a front face 4, a first wood framing member 5 having a bottom edge 7 and parallel first and second sides 8 and 9, a second wood framing member 10 having a bottom edge 12 and parallel first and second sides 13 and 14, and a sheet metal hanger 15 formed according to the present invention.

The sheet metal hanger 15 of the present invention also includes: a seat member 16 for receiving the bottom edges 7 and 12 of the first wood framing member 5 and the second wood framing member 10, a first backwall member 17 formed for registration with the front face 4 of the support header member 2, a first side member 18 integrally connected to the first backwall member 17 a right angle 19 and integrally connected to the seat member 16, a second backwall member 20 spaced from the first backwall member 17 and formed for registration with the front face 4 of the support header member 2, a second side member 21 integrally connected to the second backwall member 20 at a right angle 23 with the second side member 21 and integrally connected to the seat member 16, and a third backwall member 81 integrally connected to seat member 16 at a position generally midway between the first and second backwall members 17 and 20.

First fasteners 27 are inserted through the first backwall member 17 into the support header member 2, second fasteners 18 are inserted through the second backwall member 20 into the support header member 2, third fasteners 29 are inserted through third backwall member 81 of the sheet metal hanger 15 into the support header member 2, first arm fasteners 100 insert through third flange arm 85 into the first wood framing member 5, second arm fasteners 101 insert through first L-shaped flange arm 83 into the second wood framing member 10, third arm fasteners 102 insert through second L-shaped flange arm 84 into the third wood framing member 39, and fourth arm fasteners 103 insert through fourth flange arm 86 into fourth wood framing member 34 to complete the multiple wood framing member connection 1.

When formed for use in a multiple truss connection, a preferred embodiment of a sheet metal hanger 15 formed according to the present invention, and illustrated in FIG. 2, may be constructed from a sheet metal blank 46 using heavy gauge material to meet the load design requirements.

A typical blank 46 is illustrated in FIG. 2. A progressive die machine may be used to cut and bend the blank 46 as follows: first, the blank 46 is cut from a sheet metal coil and downward embossment 113 is formed in seat 16 adjacent front edge 114. Preferably, front edge 114 is not straight and juts out angularly as shown or even rounded. As shown, embossment 113 is not a straight line but is somewhat concave as seen in the plan view for additional strength. The progressive die preferably cuts round openings 31 in the back wall members 17 and 20 and obround openings in the flange arms 83-86. The progressive die makes cuts in blank 46 creating narrow elongated gaps 115-118, creating arms 85, 83, 86 and 84. Irregular cuts 119 and 120 are made which further define arms 83-86 and separate the arms from back wall members 17 and 20.

Next, bends are made in the blank 46 as follows, but not necessarily in the order set forth below. Backwall member 17 is bent upwardly 90° along bend line 47 or downwardly 90° depending upon whether hanger 15 as shown in FIG. 1 or hanger 15' as shown in FIG. 4 is to be made. Second back member 20 is bent upwardly 90° along bend line 48, or downwardly 90° depending on whether hanger 15 as shown in FIG. 1 or hanger 15' as shown in FIG. 4 is to be made. First side member 18 is bent up 90° along bend line 62, and second side member 21 is bent up 90° along bend line 63. First and second reinforcing flanges 67 and 68 are bent up as a unit along bend line 64. Third back wall member 81 is defined by bending first and second L-shaped flange arms upwardly 70° respectively along bend lines 87 and 91. Third and fourth flange arms 85 and 86 are bent downwardly 45° with respect to first and second L-shaped flange arms 83 and 84.

Those fastener openings 31 illustrated in the drawings as obround openings have a structure and function which is fully described in Gilb, U.S. Pat. No. 4,230,416, and which is incorporated herein by reference. Another way of constructing the obround openings 31 to permit slant fastening is described in Gilb, U.S. Pat. No. 4,480,941, which is also incorporated herein by reference.

In one preferred embodiment, for use as a multiple framing member, hanger, the connector 15 of the present invention is preferably made of 14 gauge sheet metal and finished by galvanizing. In its final configuration, such a preferred sheet metal hanger 15 can be 16.6260" in width, 4.0000" in depth, and 4.0000" in height. The first and second reinforcing flanges 67 and 68 are joined to the third back wall member 81 and each have a length of about 7.5000". Seat member 16 has a length of 16.6250" a minimum depth of 2.5973" and a maximum depth of 4.0000". First and second side members 18 and 21 have a width of 2.5973° and a height of 5.5000". First and second back wall members 17 and 20 have a width of 3.0625" and a height of 5.5000". Third back wall member 81 has a width of 1.6236" and a height of 4.000". First and second L-shaped flange arms 83 and 84 are joined to third back wall member 81 and have a maximum width of 1.7999".

Third and fourth flange arms 85 and 86 are joined to third back wall member 81 and have a width of 1.6875". The seat embossment 113 is embossed to a depth of 0.125". Circular fastener openings have a diameter of 0.1710" and obround openings have a length of 0.3750". L-shaped flange members are bent at an angle 110 of 75.5° and third and fourth flanges 85 and 86 are bent at angles 111 and 112 to 45°.

Testing is not yet complete but is expected to be in the 2400 pound range. Nailing can be with 10 d nails.

I claim:

1. A building structural hanger comprising:

a. a seat member having a first edge, a second edge, and a third edge, i. said first edge intersects said third edge at a first virtual corner, and ii. said second edge intersecting with said third edge at a second virtual corner, said second virtual corner being spaced from said first virtual corner along said third edge;

b. a first reinforcing flange extending along said third edge of said seat member from adjacent said first corner, i. said first reinforcing flange extending upwardly from said seat member to a maximum selected height;

c. a first side member having a first edge connected to a portion of said first seat edge adjacent said first corner, i. said first side member extending upwardly from said seat member to a maximum selected height greater than said first reinforcing flange, ii. said first side member having a first bend line in the same plane as said first reinforcing flange;

d. a first back wall member having a first edge extending along a portion of said bend line of said first side member, i. said first back wall member having a second edge spaced from said first edge of said first back wall member;

e. a second side member having a first edge connected to a portion of said second seat edge adjacent said second corner, i. said second side member extending upwardly from said seat member to a maximum selected height greater than said first reinforcing flange, ii. said second side member having a first bend line in the same plane as said first reinforcing flange;

f. a second back wall member having a first edge extending along a portion of said bend line of said second side member, i. said second back wall member having a second edge spaced from said first edge of said first back wall member;

g. a third backwall member extending upwardly from said third edge of said seat member a selected height greater than the height of said first reinforcing flange member and having, i. a first side edge spaced a distance substantially from said first corner, ii. a second side edge spaced a distance substantially from said second corner; and h. a first flange arm having a distal end edge and a proximal end portion formed with a proximal end bend edge connected to said third back wall member along first side edge of said third backwall member and bent at an angle from said third back wall member.

2. A building structural hanger as described in claim 1 further comprising:

a. said first flange arm is L-shaped and said proximal end portion is formed with a distal bend edge spaced from and parallel to said proximal end bend edge;

b. a third flange arm having a distal end edge and a proximal bend edge integrally attached to said distal bend edge of said first L-shaped flange arm, and c. said third flange arm being bent along said proximal bend end edge forming an acute angle with said proximal end portion of said first L-shaped flange arm.

3. A building structural hanger as described in claim 2 further comprising:

a. a second reinforcing flange extending along said third edge of said seat member from adjacent said second virtual corner, i. said second reinforcing flange extends upwardly from said seat member to a maximum selected height; and b. a second flange arm having a distal end edge and a proximal end portion having a proximal end bend edge connected to said third back wall member along second side edge of said third backwall member and bent at an angle from said third back wall member.

4. A building structural hanger as described in claim 3 further comprising:

a. said second flange arm is L-shaped and said proximal end portion is formed with a distal bend edge spaced from and parallel to said proximal end bend edge;

b. a fourth flange arm having a distal end and a proximal end edge integrally attached to said distal bend edge of said first L-shaped flange arm, and c. said third flange arm being bent along said proximal bend edge forming an acute angle with said proximal end portion of said second L-shaped flange arm.

5. A building structural hanger as described in claim 4 further comprising:

a. said seat member is formed with a substantial portion of the front edge extending a selected distance beyond the forward side edges of said first and second side members, b. an embossment in said seat member extending a substantial portion of the length of said seat member adjacent and in a non linear line in general conformity with said front edge of said seat member; and c. said building structural hanger is constructed from a single contiguous sheet of sheet metal.

6. A building structural hanger as described in claim 3 further comprising:

a. said first and second reinforcing flange members are integrally attached to said third back wall member.

7. A building structural hanger as described in claim 6 further comprising:

a. said fastener opening means in said first and second L-shaped flange arms and said fastener opening means in said third and fourth flange arms are obround in shape permitting slant insertion of fasteners there through.

8. A building structural hanger as described in claim 1 further comprising:

a. said first and second back wall members are bent inwardly toward said third back wall member and on a plane with said third back wall member.

9. A building structural hanger as described in claim 1 further comprising:

a. said first and second back wall members are bent outwardly away from said third back wall member and on a plane with said third back wall member.

10. A truss connection comprising the building structural hanger as described in claim 1 further comprising:

a. a support girder including a wood bottom chord having a front face, b. first fasteners, third fasteners and second fasteners inserted respectively through first backwall member, third backwall member and second back wall member into said bottom wall chord of said support girder, c. a first jack truss including a wood bottom chord having a bottom edge an end face and parallel first and second sides, d. said bottom edge of said first jack truss is mounted on said seat of said building structural hanger with said end face of said first jack truss mounted adjacent and spaced from said third edge of said seat member and with said first side of said wood bottom chord mounted flush with said face of said first flange arm, and e. second arm fasteners inserted through said first flange arm into said wood bottom chord.

11. A truss connection as described in claim 10 further comprising:

a. said first flange arm is L-shaped and said proximal end portion is formed with a distal bend edge spaced from and parallel to said proximal end bend edge connected to said third backwall member;

b. a third flange arm having a distal end edge and a proximal bend edge integrally attached to said distal bend edge of said first L-shaped flange arm, c. said third flange arm being bent along said proximal end edge forming an acute angle with said proximal end portion of said first L-shaped flange arm, d. a first hip truss including a wood bottom chord having a bottom edge, an end face and parallel first and second sides, e. said bottom edge of said first hip truss is mounted on said seat of said building structural hanger with said end face of said first hip truss mounted adjacent said third edge of said seat member and with said second side of said wood bottom chord mounted flush with said face of said third flange arm, and F. first arm fasteners inserted through said third flange arm into said wood bottom chord.

12. A truss connection as described in claim 10 further comprising:

a. a second reinforcing flange extending along said third edge of said seat member from adjacent said second virtual corner, i. said second reinforcing flange extends upwardly from said seat member to a maximum selected height;

b. a second flange arm having a distal end edge and a proximal end portion having a proximal end bend edge connected to said third back wall member along second side edge of said third backwall member and bent at an angle from said third back wall member;

c. a second jack truss including a wood bottom chord having a bottom edge, an end face and parallel first and second sides, d. said bottom edge of said second jack truss is mounted on said seat of said building structural hanger with said end face of said second jack truss mounted adjacent and spaced from said third edge of said seat member and with said second side of said wood bottom chord mounted flush with said face of said second flange arm, and e. third arm fasteners inserted through said second flange arm into said wood bottom chord.

13. A truss connection as described in claim 12 further comprising:

a. said first flange arm is L-shaped and said proximal end portion is formed with a distal bend edge spaced from and parallel to said proximal end bend edge, b. said third flange arm being bent along said proximal end edge forming an acute angle with said proximal end portion of said first L-shaped arm, c. a first hip truss including a wood bottom chord having a bottom edge, an end face and parallel first and second sides, d. said bottom edge of said first hip truss is mounted on said seat of said building structural hanger with said end face of said first hip truss mounted adjacent said third edge of said seat member and with said second side of said wood bottom chord mounted flush with said face of said third flange arm, and e. first arm fasteners inserted through said third flange arm into said wood bottom chord.

14. A truss connection as described in claim 11 further comprising:

a. a second L-shaped flange arm having a distal end edge and a proximal end portion is formed with a distal bend edge spaced from and parallel to said proximal end bend edge connected to said third backwall member;

b. a fourth flange arm having a distal end edge and a proximal bend edge integrally attached to said distal bend edge of said second L-shaped flange arm, c. said fourth flange arm being bent along said proximal end edge forming an acute angle with said proximal end portion of said second L-shaped flange arm, d. a second hip jack truss having a wood bottom chord having a bottom edge placed on said seat member and an end face positioned adjacent said third edge of said seat member and in registration with said fourth flange arm; and e. fourth arm fasteners inserted through said fourth flange arm and into said wood bottom chord of said second hip jack truss.

15. A truss connection as described in claim 13 further comprising:

a. said second arm having an L-shape having a distal end edge and a proximal end portion is formed with a distal bend edge spaced from and parallel to said proximal end bend edge connected to said third backwall member;

b. a fourth flange arm having a distal end edge and a proximal bend edge integrally attached to said distal bend edge of said second L-shaped flange arm, c. said fourth flange arm being bent along said proximal end edge forming an acute angle with said proximal end portion of said second L-shaped flange arm;

d. a second hip truss having a wood bottom chord having a bottom edge placed on said seat member and an end face positioned adjacent said third edge of said seat member and in registration with face of said fourth flange arm and;

e. fourth arm fasteners inserted through said fourth flange arm and into said wood bottom chord of said second hip jack truss.

16. A truss connection as described in claim 10 further comprising:

a. said fastener opening means in said first and second L-shaped flange arms and said fastener opening means in said third and fourth flange arms are obround in shape permitting slant insertion of fasteners therethrough.

17. A truss connection as described in claim 15 further comprising:

a. said first back wall member is bent inwardly along said second edge of said first back wall member toward said third back wall member and on a plane with said third back wall member; and b. said second back wall member is bent inwardly along said first edge of aid second back wall member toward said third back wall member and on a plane with said third back wall member.

18. A truss connection as described in claim 15 further comprising:

a. said first back wall member is bent outwardly along said second edge of said first back wall member away from said third back wall member and on a plane with said third back wall member; and b. said second back wall member is bent outwardly along said first edge of said second back wall member away from said third back wall member and on a plane with said third back wall member.

* * * * *